US005928726A

United States Patent [19]

Butler et al.

[11] Patent Number: 5,928,726

[45] **Date of Patent: *Jul. 27, 1999**

[54] MODULATION OF COATING PATTERNS IN FLUID CARRIER COATING PROCESSES

[75] Inventors: Terri L. Butler; Kathryn R. Bretscher, both of Minneapolis; Mark C. Berens, Oakdale, all of Minn.; James A. Baker, Hudson, Wis.; Gaye K. Lehman, Lauderdale, Minn.

[73] Assignee: Minnesota Mining and Manufacturing Company, St. Paul, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/826,571

[22] Filed: Apr. 3, 1997

[51] Int. Cl.[6] ..... B05D 5/00; B05D 1/34; B05D 3/00; B05D 1/18

[52] U.S. Cl. ..... 427/261; 427/256; 427/262; 427/337; 427/356; 427/372.2; 427/402; 427/420; 427/421; 427/428; 427/434.2

[58] Field of Search ..... 427/256, 261, 427/262, 263, 356, 337, 372.2, 402, 420, 428, 421, 434.2; 118/402; 101/492

[56] References Cited

U.S. PATENT DOCUMENTS

| | | | |
|---|---|---|---|
| 1,931,667 | 10/1933 | Loetscher | 91/68 |
| 3,679,784 | 7/1972 | Rosenberg | 264/73 |
| 4,091,126 | 5/1978 | Hidan | 427/262 |
| 4,120,608 | 10/1978 | Vassilou | 428/187 |
| 4,132,824 | 1/1979 | Kimura et al. | 428/220 |
| 4,510,094 | 4/1985 | Drahnak | 260/429 CY |
| 4,600,484 | 7/1986 | Drahnak | 204/157.74 |
| 5,045,391 | 9/1991 | Brandt et al. | 428/336 |
| 5,067,797 | 11/1991 | Yokokura et al. | 359/76 |
| 5,324,359 | 6/1994 | Cleveland et al. | 118/688 |
| 5,348,766 | 9/1994 | Latham | 427/202 |
| 5,356,706 | 10/1994 | Shores | 428/352 |
| 5,468,815 | 11/1995 | Boardman et al. | 525/478 |
| 5,500,274 | 3/1996 | Francis et al. | 428/156 |
| 5,520,978 | 5/1996 | Boardman et al. | 428/41.9 |
| 5,700,536 | 12/1997 | Steidinger | 428/40.1 |

FOREIGN PATENT DOCUMENTS

| | | | |
|---|---|---|---|
| 0 031 725 A2 | 7/1981 | European Pat. Off. | B01D 13/04 |
| 0 559 575 A1 | 9/1993 | European Pat. Off. | C08G 77/20 |
| 362947 | 12/1931 | United Kingdom . | |
| 2 148 741 | 6/1985 | United Kingdom | B05D 1/20 |
| 2148741 | 6/1985 | United Kingdom . | |
| WO 96/23595 | 8/1996 | WIPO | B05D 1/26 |
| WO 96/24088 | 8/1996 | WIPO | G03C 1/74 |
| WO 96/34318 | 10/1996 | WIPO | G03G 5/147 |

OTHER PUBLICATIONS

Derwent Abstract for JP 02 207870–A (1990).
Derwent Abstract for JP 83035723–BD (1983).
D. Satas, *Coatings Technology Handbook*, (Marcel Dekker, Inc. NY 1991 pp. 103–111,153–175.
E.Cohen & E.Gutoff, *Modern Coating And Drying Technology*, (VCH Publishers, 1992 pp. 18,,63–69, 117–122, 169–171).
Kirk–Othmer, *Encyclopedia Of Chemical Technology, Third Edition* (Wiley—Interscience, 1979, vol. 6, pp. 386–445).
Kirk–Othmer, *Encyclopedia of Chemical Technology, Fourth Edition* (Wiley—Interscience, 1993, vol. 6, pp. 606–746).
Derwent Abstract of JP 02 173080 (1990).
D. Satas, *Coatings Technology Handbook*, (Marcel Dekker, Inc. NY 1991 pp. 37–41, 103–129,139–151.
E.Cohen & E.Gutoff, *Modern Coating And Drying Technology*, (VCH Publishers, 1992 pp. 79–85, 131–133, 157–163, 286–295).
L. Boardman, *Organometallics* (1992, 11, pp. 4194–4201).
Velarde, *Sci. Amer*. 243: 92–108 (1990).
Blodgett, *J. Amer. Chem. Soc*. 57: 1007–1022 (1935).

*Primary Examiner*—Shrive Beck
*Assistant Examiner*—Michael Barr
*Attorney, Agent, or Firm*—Gary L. Griswold; John H. Hornickel

[57] ABSTRACT

A method of modulating coating patterns is disclosed. The method uses the steps of dispensing a composite comprising a carrier fluid layer and a transferring the composite to the substrate, wherein interfacial interaction among the carrier fluid layer, the functional fluid layer, and the substrate generates a patterned coating of the functional layer on the substrate. The coating patterns provide controlled release surfaces for tapes, image receptors, and the like.

11 Claims, 6 Drawing Sheets

MODULATION OF COATING PATTERNS IN FLUID CARRIER COATING PROCESSES

RELATED APPLICATIONS

This application is related to U.S. patent application Ser. No. 08/724,073 by virtue of common assignee, similar subject matter, and some common inventors. This application is also related to copending, concurrently filed, U.S. patent application Ser. Nos. 08/832,543, abandoned 08/832,834, 08/828,823 and 08/832,934, (Attorney Docket Nos. 53268USA5A, 53267USA7A, 53322USA9A, and 52291USA3A, respectively), by virtue of common assignee, similar subject matter, and some common inventors.

FIELD OF INVENTION

This present invention relates to controlling the arrangement of release coatings on surfaces.

BACKGROUND OF INVENTION

International Patent Publication WO 96/23595 (Melancon et al.) discloses a process, referred to as a carrier fluid process, for coating a composite layer onto a web. The composite layer comprises a carrier layer of fluid (such as water) and one or more functional layers (such as silicone or other polymeric materials). With subsequent removal of the carrier fluid layer, only the functional layer is left on the web. The advantage of this process is that it can be used to generate thin (i.e. less than 100 microns) and ultrathin coatings (i.e. less than 1 micron coatings) without solvent dilution.

U.S. Pat. No. 5,061,535 (Kreckel, et al.) discloses the generation of geometric patterns by flexographic or gravure printing.

The coating art also employs "Langmuir-Blodgett" type bath coaters such as described by K. Blodgett in *Journal of the American Chemical Society*, vol. 57 1935, p. 1007 and U.S. Pat. No. 4,093,757 (Barraud, et al 1978) and Japanese Patent Application 63-327260 (Masutani, etal 1990). In Langmuir bath coating, a functional layer, comprising a coating formulation is floated on the surface of a bath of water or another supportive (carrier) liquid and is then transferred to a substrate or web by dipping or rolling the substrate off of the bath surface.

Traditional methods of applying coatings to minimize coating defects are discussed in Cohen, E. D. and Gutoff, E. B., *Modern Coating and Drying Technology*, VCH Publishers, New York 1992 and Satas, D., *Web Processing and Converting Technology and Equipment*, Van Norstrand Reinhold Publishing Co., New York 1984.

SUMMARY OF INVENTION

The apparatus and method of this invention coats patterned thin to ultra-thin liquid films onto substrates. The invention includes floating or supporting a coating or functional fluid(s) on a carrier fluid, this plurality of fluid layers forming a composite. A substrate and the composite are moved in relative motion to each other so as to effect contact.

Preferably, composite layer and substrate move at a rate relative to each other that is sufficiently high enough to form a continuous fluid bridge of composite layer across the coating width of the substrate.

The contact between the composite layer and substrate results in interposing the coating or functional layer between the substrate and the carrier fluid. The carrier fluid is at least partly removed by mechanical or evaporative means while leaving the coating fluid(s) on the substrate as a coating layer. By appropriate choice of functional layer(s), carrier fluid and coating conditions, consistent patterns can be formed in the functional layer which impart useful features. The functional layer can be cured by thermal or radiative means to generate a crosslinked patterned coating. Miscible and immiscible combinations of coating and carrier fluids may be used in the composite layer.

The invention as described above differs from the fluid carrier coating processes described in Melancon et al (WO 96/23595) which is incorporated herein by reference. As significant an improvement to the coating art that Melancon et al. is, nonetheless Melancon et al. do not specifically address issues related to various coating properties, such as homogeneity, surface coverage, patterning, optical clarity, and the like, important for the coating of release surfaces. The disclosure of the Melancon et al. coating process also does not address the utility of using coating patterns to modulate functional performance, e.g., release performance. Melancon et al. also does not disclose the use of a fluid carrier to generate these patterns.

Also, "Langmuir Blodgett" type coaters have not been used in a manner to generate coating patterns for the purpose of improving functional performance of the resulting coated surface.

In fact, conventional coating literature regards coatings exhibiting such patterns as potentially flawed or defective. Such coating defects are discussed in detail in E. Cohen and E. Gutoff, *Modern Coating and Drying Technology* (see for example pp. 79–85, 156–163 and 287–290).

One aspect of the present invention is a novel approach for generating, modulating and controlling patterns produced using the Melancon et al. carrier fluid coating process or the "Langmuir Blodgett" bath coating process. The method of making a patterned coating comprises the steps of (a) dispensing a composite comprising a carrier fluid layer and a functional fluid layer; (b) bringing the composite into contact with a substrate; (c) transferring the composite to the substrate, wherein interfacial interaction among the carrier fluid layer, the functional fluid layer, and the substrate generates a patterned coating of the functional layer on the substrate.

Preferably, these coating methods can be used to provide glossy smooth coatings, translucent patterned coatings, or porous coatings.

Another aspect of the present invention is an article comprising a patterned coating on a substrate, prepared according to the above method, wherein the article comprises a temporary electrographic image receptor, a release liner, a low-adhesion-backsize material, a differential release layer, a microporous membrane, an adhesive tape, a high diffusion gradient functional layer, a filter, or a porous substrate surface modifier. The temporary electrographic image receptor can be either an electrophotographic image receptor or an electrostatic image receptor.

Another aspect of the present invention is the use of a fluid carrier in carrier fluid coating and bath coating processes to obtain controlled patterns that have desirable performance properties. Preferably, the coating patterns can comprise either generation or attenuation from a uniform coating thickness previously used in the art.

"Pattern" means an inhomogeneous coating that varies in thickness, spacial resolution, and material composition across and down web in a random, symmetrical, or periodic fashion using any theory of geometry, including without limitation, Euclidian geometry and fractal geometry.

A feature of the present invention is the ability to use known coating techniques in previously unknown manners to control the appearance, surface texture, pattern, and resulting coated surface properties of any substrate so coated.

Another feature of the present invention is the ability to generate patterns in ultra-thin liquid coatings.

Another feature of the present invention is the ability to use silicone-based release compositions in the modulated coating processes in order to provide controlled release surface patterns (on a microscopic or macroscopic scale) for use with a variety of materials that benefit from temporary contact with such patterned controlled release surfaces.

Another feature of the present invention is the ability to apply a variety of processing parameters to control (i.e., random variation, gradual variation, periodic variation, etc.) how a release surface is constructed for further industrial use.

Another feature of the present invention is the ability to generate patterned coatings from 100% solids formulations, i.e. without solvent dilution thereby avoid environmental pollution and other hazards and costs associated therewith.

Another feature of the invention is the ability to generate and control unique patterns without additional machine costs, as one might incur from tooling gravure rolls.

Another feature is the ability to make rough surfaces without tooling or additives.

Another feature is the ability to modulate peel force in tightly crosslinked coatings by varying coating parameters (as opposed to formulation and additives).

An advantage of the present invention is the versatility of using advanced known coating techniques in unexpected ways to accomplish the surprising results of producing release surfaces with precise patterns.

Another advantage of the present invention is the use of patterned release surfaces on temporary image receptors, as disclosed in copending, coassigned U.S. patent application Ser. No. 08/832,834 (Bretscher et al.) (Attorney Docket No. 53267USA5A) and as disclosed in copending, coassigned U.S. patent application Ser. No. 08/832,543, abandoned (Baker et al.) (Attorney Docket No. 53268USA5A).

Further features and advantages of the invention are apparent from a description of embodiments of the invention in conjunction with the following drawings.

EMBODIMENTS OF INVENTION

Functional Layer Composition

Figure 1A:
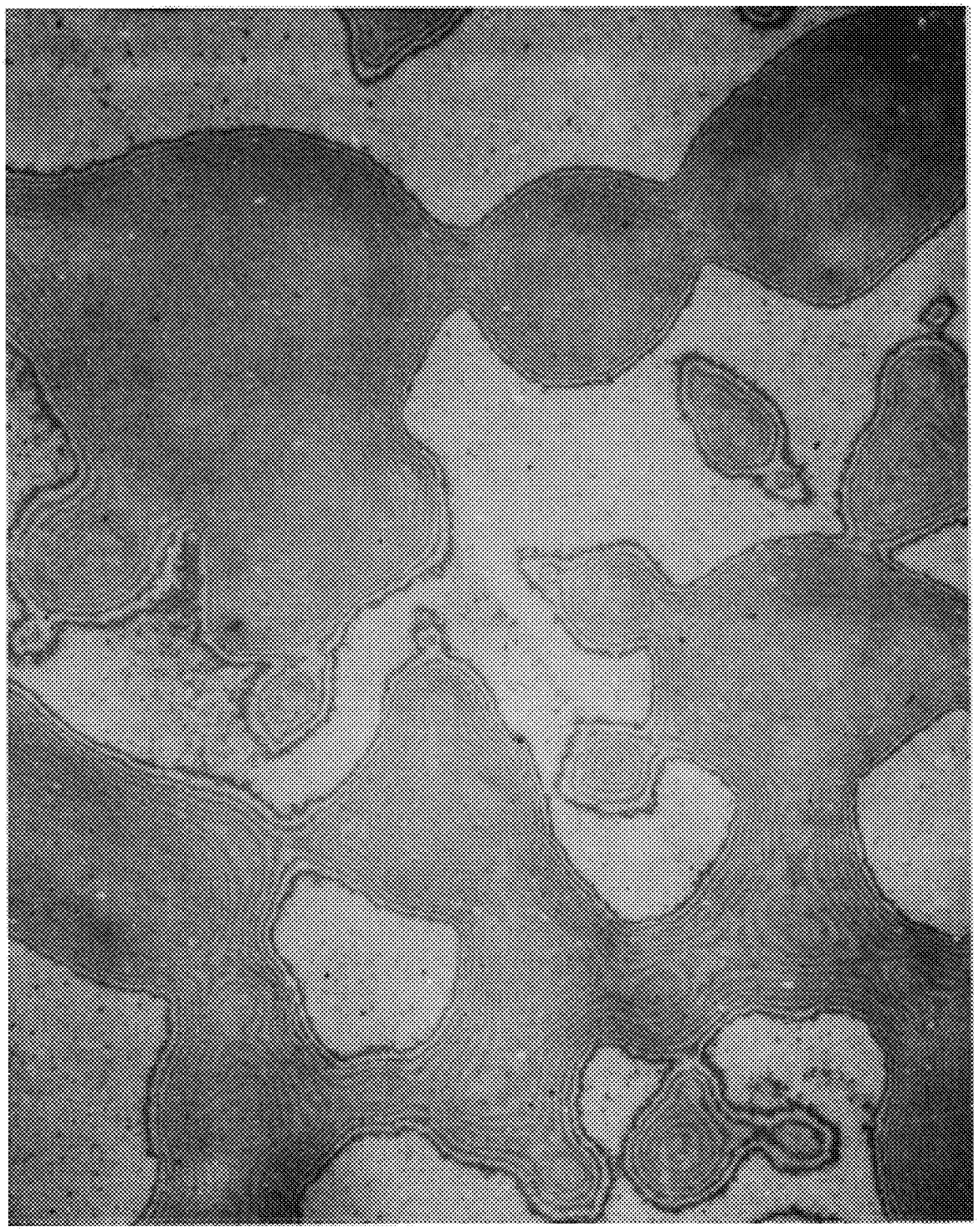
FIG. 1 is comprised of FIGS. 1A, 1B, 1C, and 1D and are photomicrographs of coatings of the present invention in an experiment that varies coating thicknesses of 10,600, 5300, 2650, and 1325 Å, respectively, while maintaining constant viscosity of the coating composition.

As used in the present invention, nonlimiting examples of functional layers include monomers, oligomers, solutions of dissolved solids, solid-fluid dispersions, fluid mixtures, and emulsions. Such fluids are useful in producing a wide range of functional coatings on webs including release coatings, low adhesion coatings, priming layers, adhesive coatings, protective coatings, optically active coatings, and chemically active coatings.

Coatings made by this invention can have utility in manufacturing products such as release liners, pressure-sensitive tapes, photographic film, electrographic printing media, magnetic recording tapes, gas separation membranes, reflective sheeting and signing, medical dressings, coated abrasives, printing plates, membranes and films. Functional coating fluids may be miscible or immiscible with the carrier fluid. Preferably, the functional fluid layer is selected from the group consisting of a release material, an adhesive, a primer, and a low adhesive backsize material.

Preferred functional layer formulations include silicone-urea release formulations (as disclosed in U.S. Pat. No. 5,045,391 (Brandt et al.) incorporated by reference herein); and silicone or fluorosilicone polymers (such as ethylenically unsaturated-, hydroxy-, epoxy- terminated or pendant functional silicone and fluorosilicone pre-polymers); or other release polymers with suitable low surface energy (such as poly(organosiloxanes), fluoropolymers, and the like) as disclosed copending, coassigned U.S. patent applications Ser. Nos. 08/724073 (Attorney Docket No. 52070USA5A); and 08/832,824 (Attorney Docket No. 53267USA7A), the disclosures of which are incorporated by reference herein. The mole percent of crosslinkable groups is preferably about 0 to 20 mole %, more preferably about 0–15 mole percent, and most preferably about 0–10 mole percent. For addition cure systems, both vinyl and alkenyl (number of carbons greater than 2 and less than 10) crosslinking groups may be used. The distribution of crosslinks may be multimodal, especially in the presence of higher molecular weight silicone gums as additives.

More preferably, functional layers are selected from the group consisting of ethylenically unsaturated-terminated and/or pendant silicone pre-polymers, silicone-urea polymers, and epoxy functional silicones and fluoropolymers disclosed above.

Preferably the silicone, fluorosilicone and fluoropolymer functional layer pre-polymers have a number average molecular weight ranging from 2,000–60,000 Da and 0–30,000 mPas, i.e. suitable for solventless coating. Additionally, solvent can be used to dissolve higher molecular weight silicone and fluorosilicone pre-polymers. More preferably, the functional layer pre-polymers have number average molecular weights of 10,000–30,000 Da with viscosities of 200–20,000 mPas.

Crosslinkers and Cure Catalysts for Addition Cure Functional Layers

The pattern may be permanently retained in the functional layer by crosslinking using thermal and radiation cure (Infra red, ultraviolet or visible light and sources of scintillating radioactivity such as electron beams, gamma ray sources and the like) systems. For addition cure silicone pre-polymers, a nonlimiting list of silyl hydride crosslinkers include Dow Corning as homopolymers (Syl-Off™ 7048), copolymers (Syl-Off™ 7678) and mixtures (Syl-Off™ 7488). Crosslinker in the amounts corresponding to 1:1 to 10:1 silyl hydride:vinyl ratio was used with an appropriate amount of an inhibitor such as a 70:30 ratio of fumarate in benzyl alcohol to achieve good cure and adequate pot life in 100% solids coating dispersion with a thermal catalyst.

For addition cure silicone functional layer polymers, both thermal and ultraviolet ("UV") initiated platinum catalysts can can be used in the formation of release surfaces of the present invention. Nonlimiting examples of platinum thermal catalysts are Dow Corning (Midland, Mich.) Syloff 4000 and Gelest (Tullytown, Pa.) platinum-divinyltetramethyldisiloxane complex (SIP6830.0 and SIP6831.0). A nonlimiting example of a platinum UV catalyst is disclosed given by in U.S. Pat. No. 4,510,094 (Drahnak). Unlike the thermal catalyst, the UV catalyst does not require an additional inhibitor since the complex is effectively inhibited until exposure to UV.

Chemical Modifiers

Chemical additives or modifiers, as discussed in copending, coassigned, U.S. patent application Ser. No. 08/832,834 (Attorney Docket No. 53267USA7A can be added to the functional layer composition. These chemical additives may include higher molecular weight gums, particulate fillers, silicate resins, surface active agents, particulate fillers, etc.

Nonlimiting examples of silicone gums include vinyl functional gums ranging in molecular weights from 30,000 to 800,000 Da available from Gelest (DMS-41, DMS-46, DMS-52) and ethylenically unsaturated organopolysiloxane compositions prepared according to U.S. Pat. Nos. 5,468,815 and 5,520,978 (Boardman) and in European Patent Publication 0 559 575 A1 (the disclosures of which are incorporated by reference herein).

Preferably, the alkenyl-functional silicones have 2 to 10 carbon atoms with a molecular weight of approximately 440,000 Da. When silicone compositions were used as additives to low viscosity silicone pre-polymers in 100% solids formulations, their molecular weight was preferably less than 800,000 Da, more preferably less than 600,000 Da, and most preferably less than 500,000 Da. Their concentration was preferably less than 20% (w/w) in the silicone pre-polymer, more preferably less than 10% (w/w) and most preferably less than 5% w/w.

A nonlimiting list of fillers include hydrophobic filmed silica such as CAB-O-SIL™ TS-530, TS-610 and TS-720 (all from Cabot Corp. of Billerica, Mass.) and AER-O-SIL™ R812, R812S, R972, R202 (from Degussa Corp. of Rigdfield Park, N.J.). A non-limiting list of low surface energy fillers includes polymethylmethacrylate beads, polystyrene beads, silicone rubber particles, teflon particles, and acrylic particles. Other particulate fillers which can be used but which are higher surface energy include but are not limited to silica (not hydrophobically modified), titanium dioxide, zinc oxide, iron oxide, alumina, vanadium pentoxide, indium oxide, tin oxide, and antimony doped tin oxide. High surface energy particles that have been treated to lower the surface energy are also useful. The preferred inorganic particles include fumed, precipitated or finely divided silicas.

More preferred inorganic particles include colloidal silicas known under the tradenames of CAB-O-SIL™ (available from Cabot Corp.) and AEROSIL™ (available from Degussa). Hydrophobically treated colloidal silica, such as CAB-O-SIL™ TS-530, TS-610 and TS-720 (all from Cabot Corp. of Billerica, Mass.), are preferred. CAB-O-SIL™ TS-530 is a high purity hydrophobic fumed silica which has been treated with hexamethyldisilazane (HMDZ). CAB-O-SIL™TS-610 is a high purity hydrophobic fumed silica treated with dichlorodimethyl silane. CAB-O-SIL™ TS-720 is a high purity hydrophobic fumed silica treated with a dimethyl silicone fluid. The treatment replaces many of the surface hydroxyl groups on the fumed silica with a polydimethyl siloxane polymer. The treatment replaces many of the hydroxyl groups on the fumed silica with trimethylsilyl groups. As a result the silica is a low surface energy particle.

Most preferably the filler is a hydrophobically modified fumed silica treated in situ with HMDZ to chemically bind the silica to the pre-polymer, available from Nusil Corporation (Carpinteria, Calif.). The composition of the hydrophobic filler is preferably 0.1 to 20%, more preferably 0.5 to 10% most preferably 1 to 5% w/w.

A non-limiting list of silicate resins include Dow Corning 7615, Gelest vinyl Q resin VQM-135 and VQM-146 which are provided as dispersions of silicate in silicone. Preferably, the silicate resin is present at 5 to 100% w/w in the silicone pre-polymer, more preferably 0 to 75%, most preferably 0 to 50% (w/w).

A nonlimiting list of surface active agents include low molecular weight acrylate based surfactants such as Modaflow (Monsanto, St. Louis, Mo.) and BYK-358 (BYK-Chemie), silicone-functional surfactants such as Silwets (OSI), and fluorochemical surfactants such as Fluorads (3M, St. Paul, Minn.) and Zonyl (Dupont, Wilimington, Del.) leveling agents.

Thickness

The mean thickness of the functional layer is preferably about 0.005 to 100 microns, more preferably about 0.01 to 25 microns and most preferably about 0.1 to 5 microns.

Substrate

The substrate can be a continuous web, discrete sheets or rigid piece parts, or an array of pieces or parts transported through the coating. Nonlimiting examples of substrates include opaque, translucent, and clear substrates; low surface energy and high surface energy substrates, textured, patterned, rough, and smooth substrates; and combinations thereof. Preferred continuous webs include transparent, translucent or opaque materials of low to high surface energy. More preferably the substrate may include polyethylene terephthalate, polycarbonate, polystyrene, and an inverted dual layer photoreceptor as described in Example 6 of PCT Patent Publication WO 96/34318 and U.S. application Ser. No. 08/431,022. Most preferably, the substrate is clear polyester.

Dispensing of the Composite of Carrier Fluid Layer and Functional Fluid Layer

Nonlimiting examples of dispensing of the composite of carrier fluid and functional fluid include dip coating, bath coating, carrier fluid coating, multilayer curtain coating, multilayer extrusion die coating, roll coating, spray coating and drip coating. Of these coating methods, carrier fluid coating and bath coating are preferred.

Carrier Fluid Coating Process Parameters

International Patent Publication WO 96/23595 (Melancon et al.), the disclosure of which is incorporated by reference herein, discloses the general parameters for use of a carrier layer of fluid (such as water) to transport a functional layer (such as silicone or other polymeric material) to a web. A preferred method is curtain coating of the composite layer.

As used in the present invention, carrier layers are preferably water and non-aqueous but water miscible liquids, more preferably water, salt solutions, and aqueous surfactant solutions, and most preferably tap water. The concentration of water in the carrier layer is preferably about 0 to 100%, more preferably about 50 to 100%, most preferably greater than 99% (w/w).

While Melancon et al. describe general processing parameters, the following parameters are important to an understanding of the scope of the present invention.

The web speed of the continuous process is preferably about 0 to 5000 m/min, more preferably about 2 to 1000 m/min, and most preferably about 10 to 300 m/min.

The curtain height is preferably about 0 to 30 cm, more preferably about 1 to 15 cm, most preferably about 2 to 5 cm.

The angle of the curtain relative to the substrate is preferably about 0 to 90 degrees, more preferably about 20 to 60 degree, more preferably about 40 to 50 degrees.

Surface coverage of the pattern is preferably about 0.1 to 99% of the surface area, more preferably about 5 to 99% of the surface area, and most preferably 20 to 99% of the surface area.

Patterning can form in a a variety of geometric patterns based on control of other parameters discussed herein. For example, control of fluid flow can alter patterns in a regular fashion, leading to a Euclidean geometric pattern.

Optical clarity is preferably clear to opaque, depending on the use of the coating.

The variation of thicknesses across surface area at the microscopic level is preferably about 0 to 10 microns, more preferably about 0 to 5 microns, most preferably about 0 to 2 microns.

Drying patterns (for example, Benard cells) may also be used to generate surface textures on release surfaces. However, the mechanism of this invention is by a different means. The mechanism of drying pattern formation either by density gradients caused by temperature gradients in a coating or by surface tension gradients is described in E. Cohen and E. Gutoff, "Modern Coating and Drying Technology," (VCH Press: NY, 1992), pp. 132–94 and Velarde and Normand, "Convection," *Scientific American,* 243, 92 (1980). For wet coating thicknesses less than 1 mm, convection cells are almost always driven by surface tension. The formation of surface tension driven convection patterns (Benard cells) is predicted by the magnitude of the Marangoni Number:

$$Ma = \frac{(d\sigma/dT)(dT/dy)h^2}{\eta[k\rho/C_p]}$$

where ($d\sigma/dT$) is variation of coating fluid surface tension with temperature, ($dT/dy$) is the temperature variation across the thickness of the wet coating, h is the wet coating film thickness, $\eta$ is the shear viscosity of the coating fluid, k is the thermal conductivity of the coating fluid, $\rho$ is the density of the coating fluid and $C_p$ is the liquid heat capacity at constant pressure of the coating fluid.

For thick coatings (i.e. wet film thickness>1 mm), surface tension driven instabilities will occur for Ma>80, however, Cohen and Gutoff note that critical Marangoni Number will be lower for thinner coatings. Marangoni instabilities will thus be enhanced by increasing the surface tension gradient with temperature ($d\sigma/dT$), the temperature gradient with wet coating thickness ($dT/dy$), and the wet film thickness (h). Similarly, Marangoni instabilities will be decreased by increasing fluid viscosity ($\eta$), increasing fluid thermal conductivity (k), increasing fluid density ($\rho$) or decreasing fluid heat capacity ($C_p$).

This invention extends beyond prespresent art by relying on the presence of three components that contribute to the creation of patterning of the coating on the substrate: the functional layer of the coating, the carrier layer of the coating, and the substrate on which the layers contact. The ability of the two layers of the coating to generate patterns prior to the evaporation or other removal of the carrier layer is a feature of the present invention. Only when both the functional layer and the carrier layer are in contact with the substrate does the possibility of interfacial interaction among the two layers and the substrate occur. This interfacial interaction contributes to the formation of the patterning of the functional layer on the substrate.

Bath Coating Process

Functional layers include the same layers as the carrier fluid coating process, described above and Melancon WO 96/23595.

The bath can use the same liquids as a carrier layer in the carrier fluid coating process, as described above and in Melancon WO 96/23595.

The following parameters are important to an understanding of the scope of the present invention.

The web speed of continuous process is preferably about 0 to 5000 m/min, more preferably about 2 to 200 m/min, and most preferably about 10 to 30 m/min.

The variation of thicknesses across surface area at microscopic level is preferably about 0 to 10 microns, more preferably about 0 to 5 microns, most preferably about 0 to 2 microns.

Patterns produced according to the method of the present invention include those having inhomogeneity in thickness, spacial resolution and maerial composition, and combinations thereof across and down a substrate during the transferring step to the substrate. Variation in the pattern can be selected from the group consisting of random, symmetrical, periodic, gradual, irregular, circular, angular, non-angular, and combinations thereof. Further the patten can result in characteristics such as a matte finish, optical transmittance, roughness, porosity, image quality, controlled release, partial coating, and combinations thereof Regardless of the type of coating process employed, the invention optionally comprises a further step of removing the carrier fluid from the substrate. Nonlimiting examples of method to remove carrier fluid include mechanical doctoring, gravity, centripetal removal, blowing, suction, solidification of carrier and doctoring, absorption into an absorptive material, gelation of carrier and doctoring, gelation of coating and doctoring, adsorption of carrier fluid, and evaporation.

Regardless of the type of coating process employed, the invention optionally comprises a further step of post-processing a functional fluid layer on the substrate. Nonlimiting examples of post-processing include drying to retain the pattern already formed in step (c), crosslinking, and separating the patterned coating from the substrate, and combinations thereof.

Usefulness of the Invention

The processes of the present invention can be used to formulate premium release surfaces by modulating the release characteristics. It can also be used to alter the optical clarity of a coating, i.e. from a glossy to translucent appearance. In another application, this coating process can be used to generate a porous, polymeric membrane.

Modulation of coating patterns is useful for controlling release characteristics, optical clarity or porosity of coatings. Generation of patterned release surfaces for optical photoreceptors for liquid electrography is demonstrated in copending, coassigned, U.S. patent application Ser. No. 08/832,543, abandoned (Baker et al.) (Attorney Docket No. 53268USA7A), the disclosure of which is incorporated by reference herein. Translucent or matte release surfaces (such as the translucent coatings generated here) can also be useful to reduce the appearance of defects in release coatings used for tapes. Patterned release surfaces may be used to control peel forces, allowing the coating method (rather than the chemistry) to be used to "fine tune" the release properties for specific applications. Patterned release coatings may be useful for medical tapes, where the pattern may modulate the characteristics of the peel from skin or other tissue. Patterned coatings may also be used to control the relative barrier and permeability characteristics of coatings. Moisture vapor permeability (MVT) may be affected, and thus this process may find application in medical tapes that require high MVT. Porous membranes and patterned films may be generated by this technique, and may find utility in controlling flow of liquids and gases.

These patterning processes can be used with 100% solids formulations, which are more environmentally benign. These patterns can be applied at coating thicknesses ranging from about 0.005 to 1000 microns. The methods of pattern generation have the advantage of bearing minimal tooling cost for changing and controlling patterns.

These methods of generating patterned surface release layers are also useful as elements of temporary receptors, as would be used for electrography, particularly electrophotographic and electrostatic printing, as discussed in copending, coassigned, U.S. patent application Ser. Nos. 08/832,834; 08/832,543, abandoned and 08/828,823.

Further embodiments and uses are described the following examples.

EXAMPLES

Raw Materials

The raw materials used consisted of curable and non-curable silicones and fluorosilicones. Addition curable, ethylenically unsaturated silicones were prepared by methods known in the art (including U.S. Pat. No. 4,609,574) and commercially obtained from Dow Corning (Syl-Off 7240; Midland, Mich.), Gelest (VDT-731; Tullytown, Pa.), United Chemical Technologies, Inc. (PS444 and PS445; Bristol, Pa.), and Nusil Technologies (PLY7500; Carpinteria, Calif.).

Release materials included base silicone or fluorosilicone addition cured pre-polymers in combination with homopolymer and/or copolymer hydride cross linkers. These pre-polymers represented a range of potential crosslinking density, afforded by the presence or absence of pendant crosslinkable groups in addition to crosslinkable endcapping groups as well as a range of (low) molecular weights, thus enabling low viscosity solventless coating formulations. The mole percent of crosslinkable groups varied between 1–10% in the pre-polymer. Both vinyl and alkenyl crosslinking groups were used. The molecular weights of the pre-polymers ranged from approximately 10,000–30,000 Da, with the lower molecular weights corresponding to useful viscosity ranges for solventless coating methods and yielding a higher effective cross link density.

Other functional silicones and fluorosilicones were also used, including epoxy functional silicone GE UV9300 (General Electric Company, Waterford, N.Y.) and mixed epoxy functional silicones (MES) prepared according to Example 1 in Kessel and Nelson in U.S. Pat. No. 5,332,797. In addition, non-crosslinkable polydimethylsiloxane viscosity standards (Brookfield Engineering Laboratories, Stoughton, Mass.) were also used. Silicone pre-polymers were also used in the absence of crosslinker and cure systems. Silicones and fluorosilicones varied in molecular weight from 10,000–30,000 Da, corresponding to useful viscosity ranges for solventless coating methods (i.e. 1–30,000 mPas).

Table 1 summarizes some of the materials used, together with their equivalent weights.

Both thermal and ultra-violet ("UV") initiated platinum catalysts were used. Examples of platinum thermal catalysts are Dow Corning (Midland, Mich.) Syl-Off 4000 and Gelest (Tullytown, Pa.) platinum-divinyltetramethyldisiloxane complex (SIP 6830.0 and 6831.0) An appropriate amount of a 70:30 mixture by weight of diethyl fumarate and benzyl alcohol (FBA) can be added as an inhibitor or bath life extender as taught in U.S. Pat. Nos. 4,774,111 and 5,036,117. A platinum UV catalyst was also used and was prepared as described in L. D. Boardman, *Organometallics,* 1992, 11, 4194–4201 and in U.S. Pat. Nos. 4,510,094 and 4,600,484 (Drahnak), the disclosures of which are incorporated by reference herein.

Silyl hydride cross linkers were obtained from Dow Corning as homopolymers (Syl-Off7048), copolymers (Syl-Off7678) and a 1:1 mixture (Syl-Off7488).

Crosslinker in the amount corresponding to 1.3:1 to 5:1 silyl hydride:vinyl ratio was used in combination with 2.40% w/w FBA in the base pre-polymer to achieve good cure and adequate pot life in 100% solids formulations. In other experiments, the formulation contained only the silicone pre-polymer, and did not include crosslinker or cure system.

Additives were used in these formulations, including hydrophobic silica (CAB-O-SIL™ TS-530 and TS-720 (all from Cabot Corp. of Billerica, Mass.) and hexamethyldisilazane in-situ treated silica in silicone (from Nusil of Carpinteria, Calif.). A coefficient of friction modifying, high molecular weight silicone gum was prepared according to the methods described in Boardman etal, U.S. Pat. Nos. 5,520,978 and 5,468,815 and was also used in some formulations. Surface active agents (SAA) included Fluorad FC431 (3M of St. Paul, Minn.), Silwet L77 (OSI Specialties, Inc. of Danbury, Conn.), Modaflow III and Modaflow 2100 (Monsanto Corp. of St. Louis, Mo.) and BYK-358 (BYK-Gardner of Columbia, Md.). Heptane was added to some samples to investigate the effect of viscosity and surface tension.

For the solventless coating formulations, Stock A contained the base silicone, gum, platinum catalyst, and a fumarate inhibitor. A fully reactive system was prepared just prior to coating by the addition of Stock B (containing the cross linker). Examples of these formulations are described in Table 2 for ethylenically unsaturated addition cure polymers. Similar formulations were prepared for vinyl functional base polymers.

TABLE 1

Summary of Material Set

| Component | Description (crosslinking functionality) | mole % vinyl | Viscosity (mPas) | MW[1] (g/mol) |
|---|---|---|---|---|
| PRE-POLYMERS | | | | |
| I | hexenyl pendant and endblocked | 2.67 | 450 | 9600 |
| II | hexenyl endblocked only | 1 | 450 | 12400 |

[1]Approximate molecular weight calculated from degree of polymerization (dp).

TABLE 2

Example Preparation of Stocks A and B for Solventless Release Formulations

| Components | Final Concentration (relative to base polymer) | Amount (g) |
|---|---|---|
| Stock A | | |
| Base silicone I | — | 833.25 |
| Syl-Off Syloff 4000 | 0.52% w/w | 19.83 |
| Pt thermal catalyst | | |
| FBA Inhibitor | 2.4% w/w | 19.80 |

TABLE 2-continued

| Example Preparation of Stocks A and B for Solventless Release Formulations | | |
|---|---|---|
| Components | Final Concentration (relative to base polymer) | Amount (g) |
| Stock B | | |
| Crosslinker Syl-Off 7048 | 5:1 Silyl hydride:vinyl | 135.12 |

Coating Methods

Coating substrates included 12"(38 cm) wide clear polyester film, aluminized PET, and an inverted dual layer photoconductor with barrier layer (the formulation of which has been described in U.S. application Ser. No. 08/431,022 Example 6, the disclosure of which is incorporated herein by reference).

Carrier Fluid Coating Process

A two layer slide die was used, as described in International Patent Publication WO 96/23595. Silicone flowed from the top slot, which had a 0.254 mm gap. Water flowed through the bottom slot, which had a 0.508 mm gap. Both slots were 248 mm wide. Municipal tap water was used as the carrier layer. The water flow rate out of the bottom die slot varied between 2.2 to 2.8 L/min (corresponding to pump rates of 21 to 22.6 rpm). The typical water temperature was 10 to 13 degrees C., except during experiments specifically designed to test the effect of higher water temperature. In these cases the water temperature was varied in a range from 10 to 66 degrees C. The thickness of the coating was controlled by varying the syringe pump rate (which metered the release formulation into the die) or by changing the web speed. Coating thickness was varied between 0.1–2 microns. Typical web speeds were 3–30 m/min. Typical syringe pump rates ranged from 1 to 5 milliliters per minute.

Langmuir Blodgett Bath Coating Process

Langmuir Blodgett Bath coating was also used. A functional layer such as silicone was applied to the surface of a water bath and drawn up onto a moving web as the web kissed the bath surface via a coating roll. The effect of temperature on this process was studied by examining the coating characteristics resulting when the bath was filled with cold water (10 degrees C.) or hot water (50 degrees C.).

Conventional Gravure Coating Process

Direct, forward offset, and reverse offset gravure methods were also used to coat samples. These methods were used to achieve a coating thickness in the target range of 0.3–2 microns for comparison to the water carrier-based processes of carrier fluid coating process and bath coating. Experiments were done on two different coating lines, one with a 3 m infrared oven and the other with a 3 m air floatation dryer. Gravure rolls with pyramidal cells having volume factors of 3–7.7 cubic billion microns were used. Web speeds were 3, 15 and 30 meters per minute (m/min). Gravure roll speeds were varied from 1 to 13.6 m/min. Gravure roll speeds were adjusted to thicken or thin a coating depending on feedback from an on-line UV gauge.

TEST METHODS

Coating thickness

The coating thickness in the gravure experiments was measured using an on-line UV gauge in a manner as disclosed in U.S. Pat. Nos. 3,956,630; 4,250,382; 4,978,731; and 4,922,113, the disclosures of which are incorporated by reference. A UV dye was mixed into the coating in a 1% (w/w) concentration. The dye in the coating was excited by UV light and the signal it emitted was proportional to coating thickness. An on-line calibration curve was generated by running the web line at a known speed and using a syringe pump to meter a known coating volume onto the web under a spreading bar. The relationship of fluorescence intensity to coating was linear in the range of interest (i.e. from 0.1–1 micron).

Optical Microscopy

A Zeiss Axioskope microscope was used to examine coatings using a magnification of 50× with a differential interference contrast lens with both reflected and transmitted light. Images were recorded with a Polaroid camera on black and white film.

EXPERIMENTAL RESULTS

Example 1

Figure 1B:
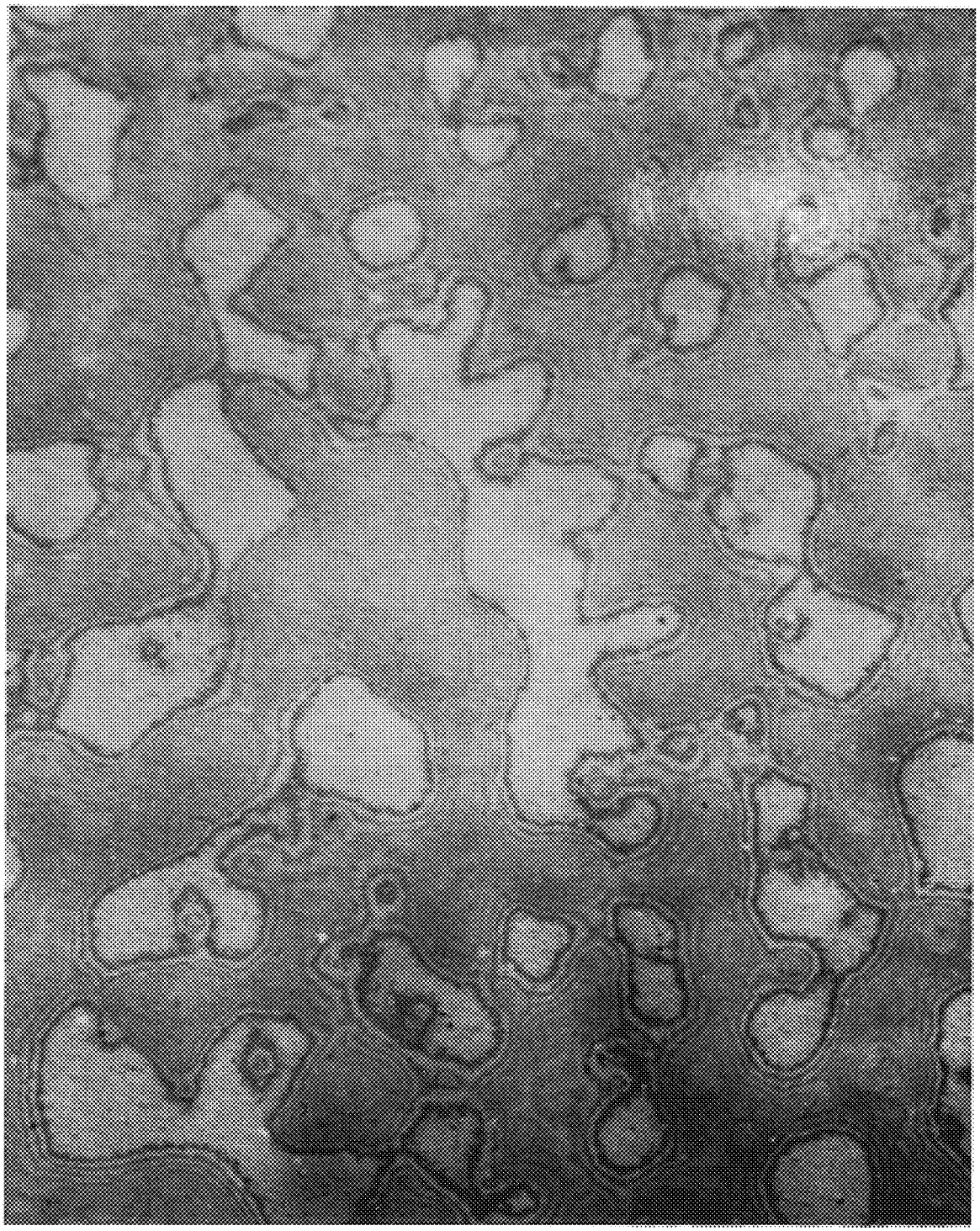
Figure 1C:
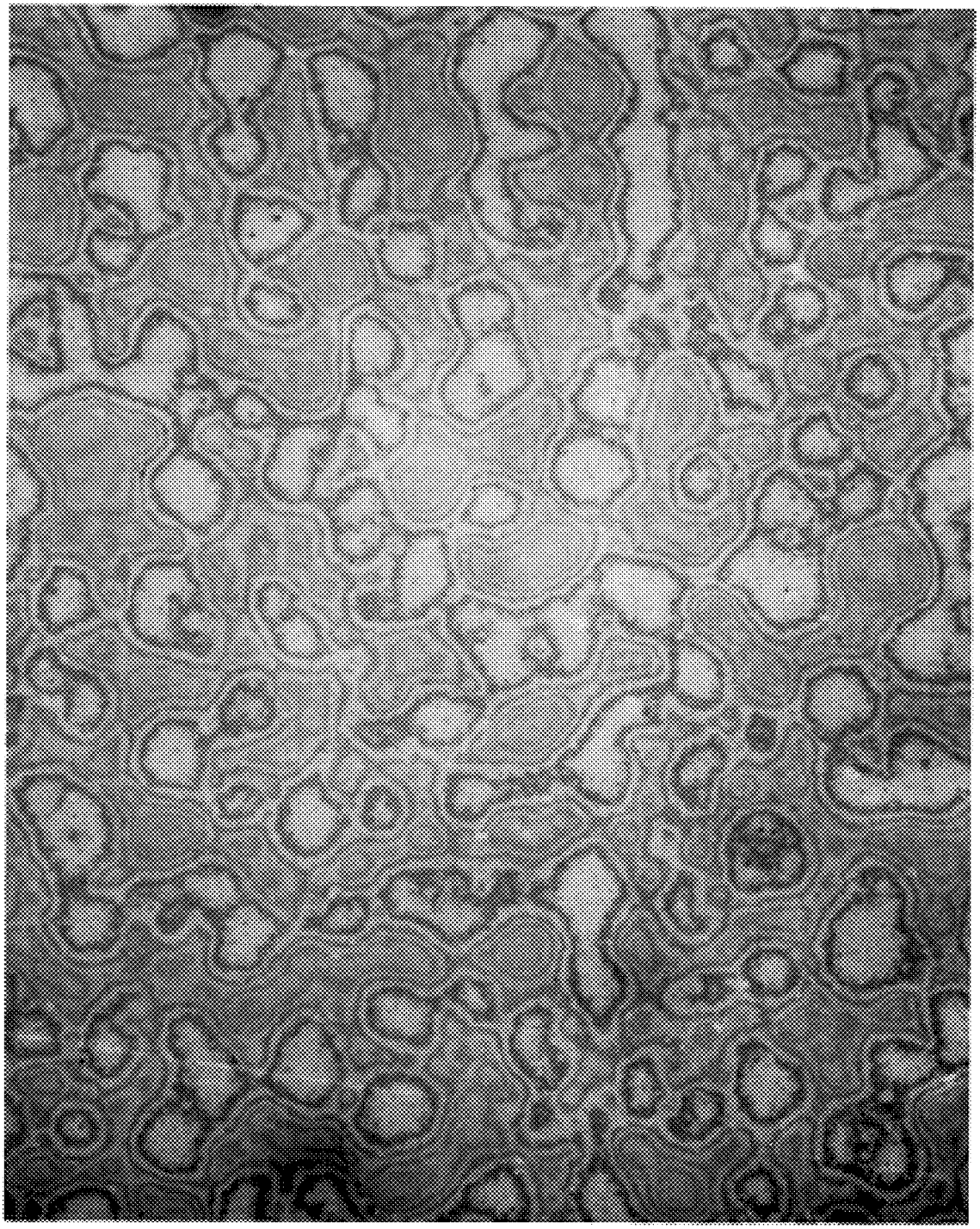
Figure 1D:
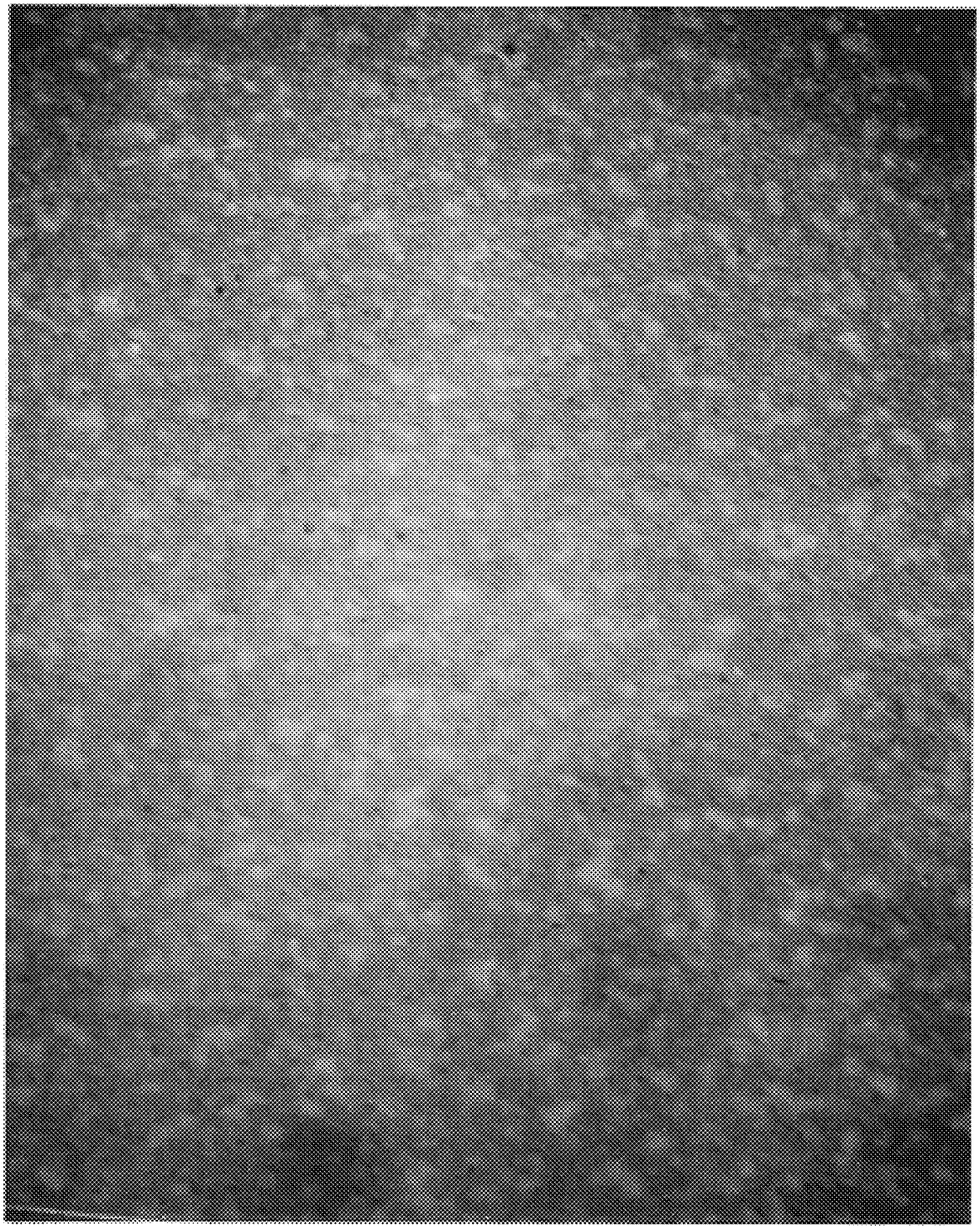

Example 1 illustrates the nature of the patterns generated by a fluid carrier coating process. The fluid carrier coating process was used to coat a functional layer of ethylenically unsaturated silicone I onto polyethylene terephthlate (i.e., polyester) substrate using water as the fluid carrier. As shown in FIG. 1 and Example 1.1 (Table 3), prominent and consistent patterns were seen on the substrate that vary in dimension with the thickness of the functional layer. These patterns were observed after the coater, but before the oven where the coatings were heat cured. These coatings could be crosslinked to preserve the pattern. At a coating thickness of approximately 1.1 microns, the coating was shown to exhibit a prominent orange peel texture, as shown in FIG. 1 A. This texture became finer as the coating thickness was reduced, showing smaller, more circular holes at 0.52 and 0.26 microns (FIGS. 1B and 1C, respectively). At coating weights corresponding to 0.13 microns (FIG. 1D), the pattern was almost indiscernible by eye; the marked characteristic of the coating was its translucent or matte finish (as opposed to glossiness).

The functional layer I (as described in Table 1) was coated onto polyester substrate using a Langmuir bath coater and direct gravure. Again, the formulation I consisted of a 100% solids formulation. Web speed and gravure roll ratios and cell patterns were chosen such that the thickness of the resulting functional layer was comparable in the three coating methods, i.e., at 0.5 microns. The coating patterns are described in Table 3. When a Langmuir bath coater was used with water as the carrier fluid, similar small round "pinhole" patterns were found in the functional layer as when the fluid carrier coating process was used (FIG. 1B and Examples 1.1 and 1.2). In contrast, as shown in Example 1.3, when gravure was used with the same 100% solids formulation and polyester substrate, but with no water (or fluid carrier layer) present, no pinhole patterns were seen. Rather, the gravure pattern was evident.

TABLE 3

Comparison of Coating Patterns Generated by Carrier Fluid Coater, Bath Coater and Gravure

| Ex | Coating Method | Viscosity (mPas) | Functional pump rate (mL/min) | Web speed (m/min) | Thickness (microns) | Temp (C.) | Coating Quality |
|---|---|---|---|---|---|---|---|
| 1.1 | Carrier Fluid Method | 450 | 1.0 | 7.6 | 0.52 | 10 | isolated pinholes cover the web (orange peel); water forms pearls down center of web |
| 1.2 | Bath Coater | 450 | 1.0 | 7.6 | 0.52 | 10 | round "pinhole" pattern similar to Carrier Fluid Coating method |
| 1.3 | Direct Gravure | 450 | NA | 15.2 | 0.6 ? | 21 | some downweb and rubber roll marks; very good coating quality; gravure pattern seen |

The absence of similar patterns with the gravure process supports the concept that the orange peel or circular patterns are not due only to an interaction between the coating material and the substrate The presence of the fluid carrier is critical to pattern generation. While not wishing to be bound by any particular theory, it is believed that the interaction of the substrate, fluid carrier, and functional layer is essential for pattern generation.

Example 2

Example 2 in Table 4 illustrates that fluid carrier coating methods can be used to generate and control patterns for silicone functional layers possessing different molecular weights, viscosities and crosslinking functionality. As shown in Table 4, within each silicone series, thinner coatings show finer patterns. Surface patterns of silicones possessing local high energy functional groups, such as the epoxy silicones (Examples 2.1–2.8), show finer patterns or more translucent coating (less obvious orange peel) at similar coating thicknesses compared to alkenyl functional silicones (Examples 2.9–2.20).

As shown in Table 4, higher viscosity silicones (corresponding to higher molecular weights) correspond to finer patterns at similar coating weights. This is seen readily in Example 2.20 (10,000 mPas) compared to Example 2.10 (450 mPas). As shown in Example 2.21, solvent can be added to the formulation to change patterning behavior.

TABLE 4

Effect of Silicone Functionality on Carrier Fluid Coating Process Coating Patterns at Varying Formulation Viscosities and Coating Thicknesses

| Ex | Functional Layer | Viscosity (mPas) | Functional pump rate (mL/min) | Water Flow Rate (L/min) | Web speed (m/min) | Thickness (microns) | Temp (C) | Coating Quality |
|---|---|---|---|---|---|---|---|---|
| 2.1 | GE UV 9300 | 230 | 1.0 | 2.6 | 3.8 | 1.1 | 10 | shiny, tiny dots on the web |
| 2.2 | GE UV 9300 | 230 | 1.0 | 2.6 | 7.6 | 0.52 | 10 | more dots on the web |
| 2.3 | GE UV 9300 | 230 | 1.0 | 2.6 | 15.3 | 0.26 | 10 | many more dots than 2.2; translucent; irregular wetting patterns are apparent |
| 2.4 | GE UV 9300 | 230 | 1.0 | 2.6 | 30.5 | 0.13 | 10 | coating is very translucent |
| 2.5 | MES | 300 | 1.0 | 2.6 | 3.8 | 1.1 | 10 | shiny, tiny dots on the web |
| 2.6 | MES | 300 | 1.0 | 2.6 | 7.6 | 0.52 | 10 | more dots on the web |
| 2.7 | MES | 300 | 1.0 | 2.6 | 15.3 | 0.26 | 10 | many more dots; translucent |
| 2.8 | MES | 300 | 1.0 | 2.6 | 30.5 | 0.13 | 10 | coating is very translucent in appearance |

| Ex | Functional Layer | Viscosity (mPas) | Functional pump rate (mL/min) | Water Flow Rate (L/min) | Web speed (m/min) | Thickness (microns) | Temp (C) | Coating Quality |
|---|---|---|---|---|---|---|---|---|
| 2.9 | I | 450 | 1.0 | 2.6 | 3.8 | 1.1 | 10 | prominent fishnet or orange peel pattern with large circular holes and dewetting patterns |

-continued

| Ex | Functional Layer | Viscosity (mPas) | Functional pump rate (mL/min) | Water Flow Rate (L/min) | Web speed (m/min) | Thickness (microns) | Temp (C) | Coating Quality |
|---|---|---|---|---|---|---|---|---|
| 2.10 | I | 450 | 1.0 | 2.6 | 7.6 | 0.52 | 10 | orange peel effect |
| 2.11 | I | 450 | 1.0 | 2.6 | 15.3 | 0.26 | 10 | finer scale orange peel than 2.10 - but still prominent |
| 2.12 | I | 450 | 1.0 | 2.6 | 30.5 | 0.13 | 10 | fine dewetting pattern or holes, translucent, looks like epoxy silicones |
| 2.13 | Nusil PLY 7500 | 1000 | 1.0 | 2.6 | 3.8 | 1.13 | 10 | prominent orange peel |
| 2.14 | Nusil PLY 7500 | 1000 | 1.0 | 2.6 | 7.6 | 0.52 | 10 | finer but obvious orange peel |
| 2.15 | Nusil PLY 7500 | 1000 | 1.0 | 2.6 | 15.3 | 0.26 | 10 | very fine orange peel |
| 2.16 | Hulls PS444 | 5000 | 1.0 | 2.6 | 3.8 | 1.13 | 10 | tiny holes visible to the eye |
| 2.17 | Huls PS444 | 5000 | 1.0 | 2.6 | 7.6 | 0.52 | 10 | tiny holes in a dense pattern and no water dewetting streaks |
| 2.18 | Huls PS444 | 5000 | 1.0 | 2.6 | 15.3 | 0.26 | 10 | very grainy texture, tiny densely packed holes; slight water droplet dewetting patterns |
| 2.19 | Huls PS445 | 10,000 | 1.0 | 2.6 | 3.8 | 1.1 | 10 | tiny holes and a speckled web (but fewer than 2.18) |
| 2.20 | Huls PS445 | 10,000 | 1.0 | 2.6 | 7.6 | 0.52 | 10 | very tiny, readily discernable dots; grainy |
| 2.21 | I and heptane (1:1) | <<450 | 2.0 | 2.6 | 7.6 | 0.52 | 10 | orange peel, many water patterns on the web, dewetted areas |

Example 3

Figure 2A:
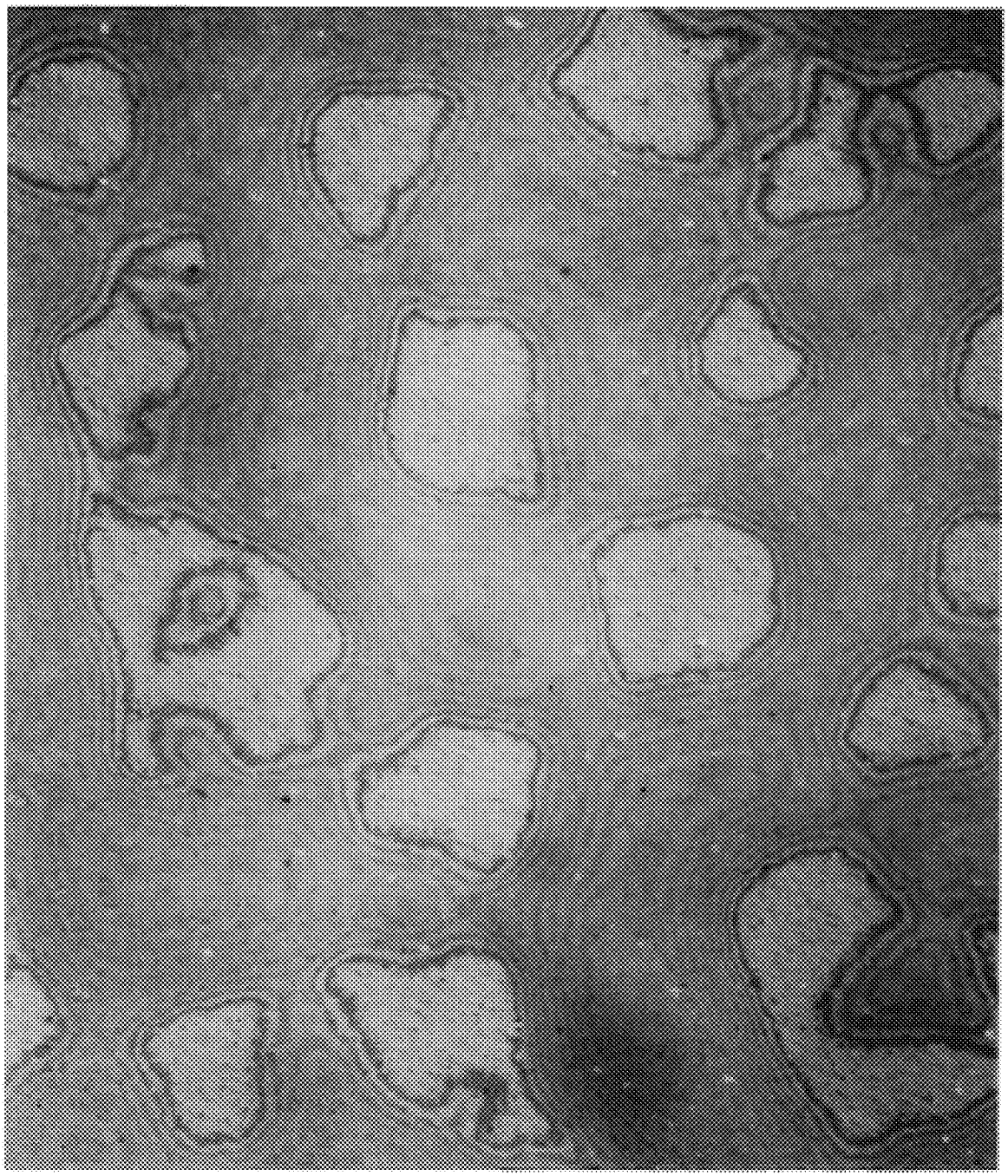
FIG. 2 is comprised of FIGS. 2A and 2B and are photomicrographs of coatings of the present invention in an experiment that varies viscosities of the coating composition of 500 and 30,000 mPas, respectively, while maintaining constant coating thickness.
Figure 2B:
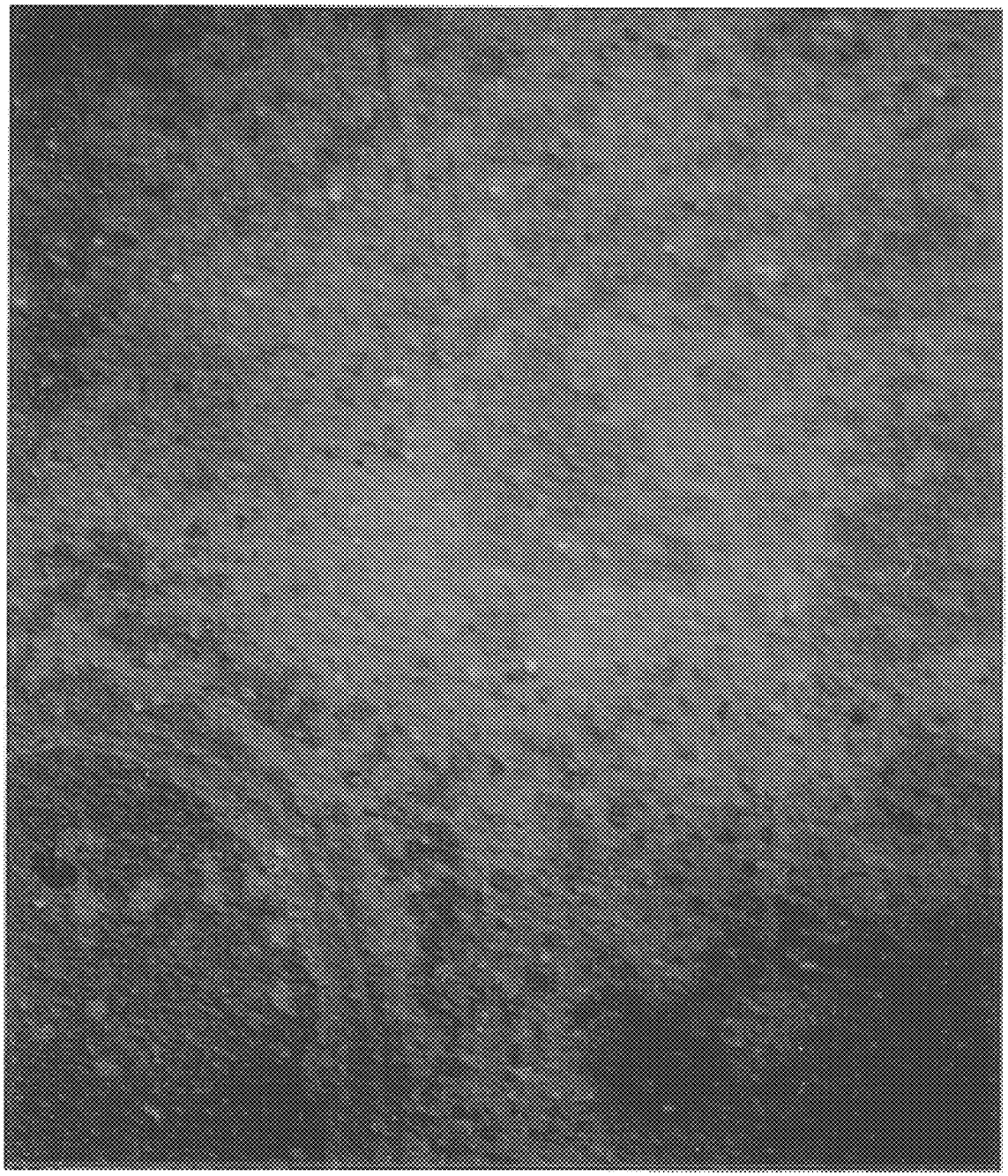

Example 3 in Table 5 and FIG. 2 further illustrate the effect of functional layer viscosity on pattern generation with a fluid carrier coating method. The effect of viscosity was examined using polydimethylsiloxane viscosity standards, purchased from Brookfield. As shown in FIG. 2*a*, prominent orange peel was seen with a 500 mPas silicone, similar to that shown in FIG. 1*b* for the similar viscosity alkenyl functional silicone (I). At higher viscosities, such as 30,000 mPas in FIG. 2*b*, the coating was glossy with only very tiny circular patterns, generating a translucent or matte finish. However, downweb ribbing patterns were apparent in the coating. Additional results are shown in Examples 3.1 to 3.12 for a series of viscosity standards (480–30,000 mPas) coated at thicknesses ranging from 0.26 to 1.1 microns. Example 3 demonstrates that for a homologous series of functional layer polymers, patterns can be controlled through appropriate choice of viscosity and coating weight. Patterns can be modulated to achieve glossy, translucent (or matte finish), or porous coatings. In constrast to gravure coating, no retooling costs are required for pattern control.

TABLE 5

Effect of Coating Thickness and Viscosity on Modulating the Release Coating Pattern Characteristics Generated by Carrier Fluid Coating

| Example | Viscosity (mPas) | Functional pump rate (mL/min) | Water Flow Rate (L/min) | Web speed (m/min) | Thickness (microns) | Temp (C) | Coating Quality |
|---|---|---|---|---|---|---|---|
| 3.1 | 480 | 1.0 | 2.6 | 3.8 | 1.1 | 10 | large circular craters and dewetting patterns; translucent |
| 3.2 | 480 | 1.0 | 2.6 | 7.6 | 0.52 | 10 | finer circular craters and dewetting patterns that Ex. 1.1; translucent |
| 3.3 | 480 | 1.0 | 2.6 | 15.3 | 0.26 | 10 | finer circular craters and dewetting patterns than 3.2 - still very visible |
| 3.4 | 1000 | 1.0 | 2.6 | 3.8 | 1.1 | 10 | large, obvious dewetted areas |
| 3.5 | 1000 | 1.0 | 2.6 | 7.6 | 0.52 | 10 | shiny coating with tiny holes; these did not dewet to form craters |
| 3.6 | 1000 | 1.0 | 2.6 | 15.3 | 0.26 | 10 | many tiny holes; coating is translucent |

| Example | Viscosity (mPas) | Functional pump rate (mL/min) | Water Flow Rate (L/min) | Web speed (m/min) | Thickness (microns) | Temp (C) | Coating Quality |
|---|---|---|---|---|---|---|---|
| 3.7 | 11,800 | 1.0 | 2.6 | 7.6 | 0.52 | 10 | shiny coating with very tiny holes that are visible under a microscope |
| 3.8 | 11,800 | 1.0 | 2.6 | 15.3 | 0.26 | 10 | more tiny holes in coating |
| 3.9 | 11,800 | 1.0 | 2.6 | 24.4 | 0.16 | 10 | many tiny holes in coating |
| 3.10 | 30,000 | 1.0 | 2.6 | 3.8 | 1.1 | 10 | tiny holes are visible only as dots to the eye; difficult to get good crossweb distribution with this viscosity |
| 3.11 | 30,000 | 1.0 | 2.6 | 7.6 | 0.52 | 10 | shiny coating; very tiny holes, downweb interference patterns (stripes) |
| 3.12 | 30,000 | 1.0 | 2.6 | 15.3 | 0.26 | 10 | shiny coating, very tiny holes in somewhat greater number than 4.11 |

Example 4

Example 4 illustrates the effect of altering the surface tension gradient between the water and the silicone by adding surface active agents (SAA's) to the silicone phase. SAA's can also be used in the fluid carrier.

TABLE 6

Effect of Surface Tension Modifiers and Leveling Agents on Patterned Release Surfaces Generated by Fluid Carrier Coating Process

| Ex | SAA | Viscosity (mPas) | Functional pump rate (mL/min) | Water Flow Rate (L/min) | Web speed (m/min) | Thickness (microns) | Temp (C) | Coating Quality |
|---|---|---|---|---|---|---|---|---|
| 4.1 | II + 1% Silwet L77 | 450 | 1.0 | 2.6 | 7.6 | 0.52 | 10 | shows exaggerated patterns |
| 4.2 | II + 0.5% Fluorad FC-431 | 450 | 1.0 | 2.6 | 7.6 | 0.52 | 10 | shows exaggerated patterns |
| 4.3 | I + 0.5% Modaflow resin | 450 | 1.0 | 2.6 | 7.6 | 0.52 | 10 | reduced patterns; showed brushstroke patterns |
| 4.4 | I + 0.25% Modaflow 2100 | 450 | 1.0 | 2.6 | 7.6 | 0.52 | 10 | rough micromixture; no round holes but dewetting marks and tranlucent coating |
| 4.5 | I + 1.0% Modaflow 2100 | 450 | 1.0 | 2.6 | 7.6 | 0.52 | 10 | translucent; irregular wetting patterns; wetting streaks |
| 4.6 | Nusil PLY7500 + HMDZ silica (3% TS530) | 1000 | 1.0 | 2.6 | 7.6 | 0.52 | 10 | obvious finer orange peel (similar to silicone without silica); good curtain stability - better than formulations with unbound silica |
| 4.7 | Nusil PLY7500 + 3% TS530 | 1000 | 1.0 | 2.6 | 7.6 | 0.52 | 10 | difficult to maintain a stable curtain; seashore coating pattern and dark silica agglomerates |

As shown in Examples 4.1 and 4.2, addition of silicone or fluorine containing SAA's can induce severe patterning of the coating compared to Examples 2.10 and 3.10. Use of a leveling agent, such as Modaflow, can attenuate the patterns to show a brushstroke texture, matte or translucent coating (Examples 4.3 and 4.4). Increasing the concentration of Modaflow 2100 can lead to wetting streaks from the water carrier fluid dewetting and irregular coating patterns (Example 4.5). Including hydrophobic bound silica (for example hexamethyldisilazane in situ treated silica, Example 4.6) leads to a similar, fine orange peel pattern like Example 2.14 (which contains the same silicone without silica). Use of an HMDZ-in situ treated silica is preferred over unbound hydrophobic silica for the water carrier process, because the unbound silica gave a very unstable water curtain (Example 4.7). Water drainage patterns associated with the incorporation of SAA's (as illustrated in Examples 4.3 and 4.5) may be reduced or eliminated by using an air bar for water removal in the carrier fluid coating process set up (instead of relying solely on drainage).

Example 5

In addition to including a SAA in the formulation (or in the water curtain), the temperature of either the water or the silicone (or both) can be altered to change the surface tension. This is illustrated in Example 5 in Table 7 in which the water temperature was varied between 10 to 30 degrees C. in a carrier fluid coating process. The functional layer formulation consisted of alkenyl functional silicone I. The coating substrate was clear polyester.

TABLE 7

Modification of the Surface Tension of Water through Adjusting the Temperature of Fluid Carrier

| Ex | Viscosity (mPas) | Functional pump rate (mL/min) | Water Flow (L/min) | Web speed (m/min) | Thickness (microns) | Temp (C) | Coating Quality |
|---|---|---|---|---|---|---|---|
| 5.1 | 450 | 1.0 | 2.2 | 7.6 | 0.52 | 10 | orange peel |
| 5.2 | 450 | 1.0 | 2.2 | 7.6 | 0.52 | 38 | orange peel |
| 5.3 | 450 | 1.0 | 2.2 | 15.3 | 0.26 | 38 | finer orange peel |
| 5.4 | 450 | 1.0 | 2.2 | 7.6 | 0.52 | 49 | a little finer orange peel than control |
| 5.5 | 450 | 1.0 | 2.2 | 15.3 | 0.26 | 49 | air entrained |
| 5.6 | 450 | range | 2.2 | range | range | 66 | at all speeds and pump rates, the curtain was unstable; fine orange is the small amounts that could be coated; much turbulance and downweb chatter |

Conditions were chosen to give an orange peel pattern at 10 degrees C. for the control (Example 5.1). As the temperature was increased to 38 and 49 degrees C., a much finer pattern was achieved (Examples 5.3 and 5.4). At higher web speeds at 49 degrees C., air was entrained so a coating was not deposited (Example 5.5). At 66 degrees C., the curtain was unstable (Example 5.6), resulting in much turbulence and downweb chatter (or seashore patterns). However, we note that in coated portions of the web at 66 degrees C., the pattern size was very fine. A slot size larger than 0.51 mils and a higher flow rate may improve the stability of the curtain and make coating at this temperature possible. We also note that with the present die design for carrier fluid coating process, heating the water also resulted in heating the silicone. The die could be redesigned to preferentially use temperature to alter the surface tension and viscosity of one phase relative to the second phase.

Coatings were also made on the bath coater at elevated temperatures. At 59 degrees C. and 15 m/min, silicone formulation I was observed to "neck" into the water, rather than spreading evenly onto the polyester substrate. Addition of a SAA such as 0.5% BYK-358 caused the silicone to spread chaotically on the bath surface.

Examples 3, 4 and 5 illustrate a general approach for controlling patterns in coating processes using a fluid carrier, namely, modifying the surface tension of the water and/or oil phase in combination with process and formulation parameters (such as coating thickness, viscosity, etc.). Surface tension modifiers in these examples include (but are not limited to) SAA's (surfactants, wetting agents, leveling agents, particles, etc.) and temperature.

The invention is not limited to the above embodiments. The claims follow.

What is claimed is:

1. A method of making a patterned coating comprising the steps of:

(a) dispensing a multilayer composite comprising a carrier fluid layer and a functional fluid layer;

(b) bringing the composite into contact with a substrate;

(c) transferring the composite to the substrate, wherein interfacial interaction among the carrier fluid layer, the functional fluid layer, and the substrate generates a patterned coating of the functional fluid layer on the substrate only when both the functional fluid layer and the carrier fluid layer are in contact with the substrate; and (d) after the transferring step (c), removing the carrier fluid layer from the substrate.

2. The method of claim 1, wherein the dispensing step (a) is selected from the group consisting of bath coating, carrier fluid coating, multilayer curtain coating, multilayer extrusion die coating, roll coating, spray coating and drip coating.

3. The method of claim 1, wherein the removing step (d) is selected from the group consisting of mechanical doctoring, gravity, centripetal removal, blowing, suction, solidification of carrier and doctoring, absorption into an absorptive material, gelation of carrier and doctoring, gelation of coating and doctoring, adsorption of carrier fluid, and evaporation.

4. The method of claim 1, wherein the carrier fluid layer is not air.

5. The method of claim 1, wherein the functional fluid layer is selected from the group consisting of a release material, an adhesive, a primer, and a backsize material.

6. The method of claim 5, further comprising the step (e) of post-processing the functional fluid layer on the substrate.

7. The method of claim 6, wherein the post-processing is selected from the group consisting of drying to retain the pattern already formed in step (c), crosslinking, and separating the patterned coating from the substrate, and combinations thereof.

8. The method of claim 1, wherein the substrate is an opaque, smooth substrate.

9. The method of claim 1, wherein the pattern has inhomogeneity of thickness, spacial resolution or material composition, or combinations thereof across and down a substrate during the transferring step (c).

10. The method of claim 9, wherein variation in the pattern is selected from the group consisting of random, symmetrical, periodic, gradual, irregular, circular, angular, non-angular, and combinations thereof.

11. The method of claim 1, wherein the transferring step (c) results in a pattern having characteristics selected from the group consisting of matte finish, optical transmittance, roughness, porosity, image quality, controlled release, partial coating, and combinations thereof.

* * * * *